United States Patent [19]

Berger

[11] Patent Number: 4,581,860

[45] Date of Patent: Apr. 15, 1986

[54] SADDLE-SHAPED CABLE DOME SYSTEM FOR LARGE SPAN LIGHTWEIGHT ROOF STRUCTURES

[76] Inventor: Horst L. Berger, 18 Chestnut Dr., Hastings-on-Hudson, N.Y. 10706

[21] Appl. No.: 746,976

[22] Filed: Jun. 20, 1985

[51] Int. Cl.[4] ..... E04B 1/34; E04B 1/345

[52] U.S. Cl. ..... 52/63; 52/2; 52/72; 52/80; 52/83; 52/741

[58] Field of Search ..... 52/2, 80, 83, 63, 72, 52/741

[56] References Cited

U.S. PATENT DOCUMENTS

| | | | |
|---|---|---|---|
| 2,716,992 | 9/1955 | Campfield et al. | 52/63 X |
| 2,753,019 | 7/1956 | Phane | 52/2 |
| 3,085,365 | 4/1963 | Winston | 52/2 |
| 3,151,663 | 10/1964 | Bohner et al. | 52/2 X |
| 3,288,158 | 11/1966 | Gugliotta | 52/63 X |
| 3,410,039 | 11/1968 | Brezina | 52/80 |
| 3,601,944 | 8/1971 | Shepherd | 52/63 X |
| 3,835,599 | 9/1974 | Geiger | 52/80 X |
| 4,130,969 | 12/1978 | Ivanov | 52/80 |
| 4,271,641 | 6/1981 | Kawaguchi | 52/80 X |

FOREIGN PATENT DOCUMENTS

| | | | |
|---|---|---|---|
| 1319962 | 1/1963 | France | 52/82 |
| 605917 | 5/1978 | U.S.S.R. | 52/83 |

*Primary Examiner*—Alfred C. Perham

*Attorney, Agent, or Firm*—Cooper, Dunham, Clark, Griffin & Moran

[57] ABSTRACT

Disclosed is a shelter structure using a saddle-shaped cable dome system for a large-span, lightweight roof membrane. The structure uses the curvatures of a saddle surface, combined with two orthogonal cable nets separated by a set of compression struts, to create an efficient structural system confined by an edge ring loaded primarily in compression.

9 Claims, 6 Drawing Figures

SADDLE-SHAPED CABLE DOME SYSTEM FOR LARGE SPAN LIGHTWEIGHT ROOF STRUCTURES

BACKGROUND AND SUMMARY OF THE INVENTION

The invention is in the field of shelter structures and is related particularly to structures using support elements and curved, lightweight roof membrane shapes spanning them. Examples are air supported structures, tension structures, tent-like structures, arch-supported membranes and free-span, point-supported systems. A survey of fabric tension structures for permanent buildings can be found in a presentation by the inventor herein to the International Symposium on Spatial Roof Structures at Dortmund, Germany, Sept. 10, 1984, entitled "A Decade Of Fabric Tension Structures For Permanent Buildings". Additional background material on such structures can be found in the twelve (12) references cited at pp. 19 and 20 of this presentation. The presentation and the 12 references are hereby incorporated by reference in this specification as though fully set forth herein.

Tension structures depend upon shape and prestress for their stability and capacity of carrying superimposed loads. Tent-like tension structures are generally center-supported systems which may use suspension bridge concepts and double cantilevers. One or several peaks supported by central masts are the common forms. The "Florida Festival" structures at Seaworld in Orlando, Fla., use the tent principle in a composition of vertical tents and their inversion. The roof membranes are supported by the radial cables spanning from central poles to concrete edge beams. When internal supports are not desirable special means have to be developed to achieve free spans. Arch supported structures are one method of developing free spans. One example is the Bullocks Department Store in San Jose, Calif., in which the roof fabric rides over a system of arches. Another method of creating free-span structures relies on point-supported systems; for example systems in which the free span is created by a large A-frame supporting the main structural peak, from overhead, in combination with peripheral posts restrained by stay cables. An example is the outdoor pavilion for Crown Center in Kansas City, Mo. Other examples of free span tension structures are described or referred to in said presentation and its references.

The desirable characteristics of structures of this general type include high strength to weight ratio, ease of erection and low cost. While much progress has been made in this field, it is believed that much need still remains for achieving a significantly improved balance of these and other desirable characteristics, and the invention is directed to meeting that need.

One principle utilized in this invention is the use of double curvature to create a stable form, to allow an economical stress flow and to minimize the use of compression members except directly over the support members.

In a particular and nonlimiting embodiment, the invention comprises a saddle-shaped cable dome system for large-span, lightweight roof structures, and uses the curvature of a saddle surface, combined with two orthogonal cable nets separated by a set of compression struts, to create an efficient structural system confined by an edge ring loaded primarily in compression. The edge ring can take on a circular, elliptic, superelliptic, or approximately superelliptic shape in plan view. The two saddle surface nets are generated by one direction of each net taking on a very small curvature and the other direction assuming a significantly greater curvature. The elements and the interaction thereof are selected such that the result is a funnicular edge ring under pre-stress. The compression struts connect related node points of the two nets, transferring loads between them. As a result, the cables with the greater curvatures are the primary carriers of loads, while the cables with the shallower curvature act primarily as restraining cables. If the supports of the edge ring are allowed to move without horizontal restraint, the system can adjust to find equilibrium even if the edge ring is hinged at the node points. Support restraints and ring stiffness reduce the amount of ring movement required to achieve equilibrium.

The curvature of the upper carrying cables which support the roof membrane results in the double curved configuration of the membrane. In the direction of the upper carrying cables the membrane takes on a curvature parallel to that of the upper carrying cables. At right angles to the upper carrying cables the membrane takes on curvature in the opposite direction. As a result, it sags down between the cables giving it the correct shape to carry downward loads, such as snow. Under the wind suction loading, the membrane is pulled upwards until it reverses its curvature at right angles to the upper carrying cables (see dashed line of FIG. 3). This is easily accommodated because the curvature in the long direction is very small. Therefore, the increase in stress in the long direction is acceptable. It has the added advantage of absorbing part of the wind load. By this method, the membrane is capable of carrying any combination of anticipated loads.

The exemplary system allows for particularly efficient construction. For example, after construction of the edge ring and its supports, the main carrying cables for downward loads of the lower net are installed, then the restraining cables of the same net are placed on top of the carrying cables to form the lower net. Then the restraining cables of the upper net are placed over the lower net. Next, the compression struts are placed on the lower net nodes and held in place near their upper ends by the upper restraint cables. The upper carrying cables are then installed, completing the upper net. Finally, the net systems are prestressed, completing the primary structural system. Prestressing can be achieved by tensioning of cables, expanding of struts, or a combination of these two methods.

In the case of using a fabric roof, the compression struts can extend above the level of the upper restraining cables by the distance required for the fabric curvature. The upper carrying cables can be placed on top of the strut extensions, with the fabric skin attached to the upper carrying cables and forming trough-like long strips which sag between adjacent carrying cables. An inner liner can be secured to the upper or the lower net. The shape of the substantially parallel, trough-like strips of outer skin allows for the use of a retractable center portion of the roof.

More specifically, an exemplary embodiment of the invention comprises a cable dome system using a substantially rigid, generally laterally extending edge ring which is loaded primarily in compression. A lower cable net is secured to the edge ring and comprises a set of carrying cables intersected by a set of restraining cables running in a direction transverse to that of the carrying cables, to form therewith a substantially rectangular (in plan view) lower grid. An upper cable net is secured to the edge ring and comprises a set of carrying cables aligned (in plan view) with the restraining cables of the lower net and a set of restraining cables aligned (in plan view) with the carrying cables of the lower net, to form a similar substantially rectangular (in plan view), upper grid. The cables of the lower net intersect at an array of lower nodes, and those of the upper net intersect at a similar array of upper nodes which are generally aligned (in plan view) with those of the lower net. Upwardly extending compression struts secure to each other, and space from each other, the vertically aligned lower and upper nodes. The curvatures of the carrying cables (in elevational view) are significantly greater than those of the restraining cables, so that the carrying cables act as the primary carriers of vertical loads as compared with the restraining cables. The curvatures of the carrying cables of the upper are convex in elevational view, and the curvatures of the carrying cables of the lower net are concave in elevational view. The carrying cables of the upper net can be above and spaced from the restraining cables of the same net, so that a membrane secured to the upper carrying cables can sag and form troughs between the upper carrying cables.

Because the trough-like runs of the roof skin have substantially parallel sides, simple, rectangular strips of roofing material can be installed easily and can maintain high strength. Little fabric waste results, because the only nonrectangular skin shapes are those at the edge ring. The upper carrying cables can be uniformly spaced from each other, to allow for constant width roof strips which, when installed, form convenient troughs for water runoff. In addition, the constant width of the skin strips between the upper carrying cables allows for the convenient use of systems for retracting central portions of the roof. The edge ring can be unitary (for example, it can be made of continuous reinforced concrete or of welded steel beams) or it can be assembled from individual sections.

The upper carrying cables are so located that the distance between them is constant in any one bay. This makes it possible to install a retractable roof with tracks loaded on top of the upper carrying cables.

DETAILED DESCRIPTION

Figure 1:
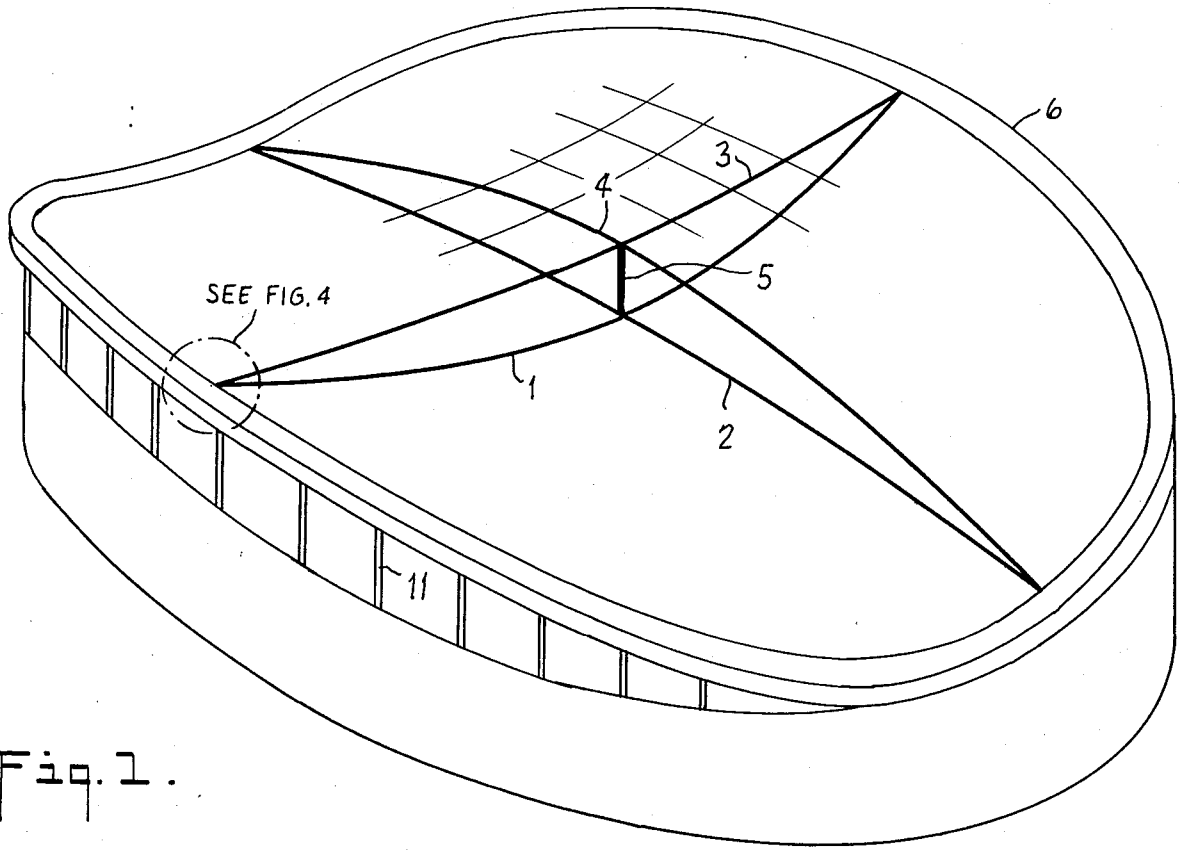
FIG. 1 is a simplified perspective view illustrating the overall shape of a cable dome structure embodying an example of the invention.

Referring to FIG. 1, a substantially rigid edge ring 6 has a superelliptic outline in plan view. In an elevational view parallel to its long axis, it has a convex outline symmetrical about its center. In an elevational view parallel to its short axis it has a concave outline, also symmetrical about its center.

A lower cable net includes exemplary carrying cable 1 and is secured to edge ring 6 such that each lower carrying cable is substantially parallel (in plan view) to the short axis of edge ring 6. For clarity, FIG. 1 shows only the carrying cable passing through the center of the ring, but in practice there is a set of lower carrying cables 1, preferably but not necessarily uniformly spaced from each other, substantially parallel (in plan view) to the short axis of ring 6, and having concave curvatures (in elevational view). The lower cable net further comprises a set of restraining cables 2, of which only the one passing through the center of ring 6 is illustrated in FIG. 1. In practice there is a set of restraining cables 2 which are spaced from each other along the short axis of ring 6, preferably but not necessarily uniformly, and are substantially parallel to the long axis of ring 6 in plan view.

An upper cable net is also secured to edge ring 6 and comprises a set of carrying cables 4 aligned in plan view with respective restraining cables 2 of the lower net. For clarity, only the central upper carrying cable 4 is shown in FIG. 1. The upper net further comprises a set of restraining cables 3, aligned in plan view with respective carrying cables 1 of the lower net. Again, for clarity only the central upper restraining cable 3 is shown in FIG. 1.

A respective compression strut 5 secures to each other, and spaces vertically from each other, the vertically aligned nodes of the lower and upper cable nets. For clarity, only the central compression strut 5, coinciding with the center of edge ring 6, is shown in FIG. 1. The curvatures of carrying cables 1 and 4 in elevational view are significantly greater than those of restraining cables 2 and 3. As a result, the carrying cables are the primary carriers of vertical loads as compared with the restraining cables. In the particular embodiment discussed in detail here, lower carrying cables 1 are concave in elevational view while upper carrying cables 4 are convex. However, this is not a limitation of the invention.

Figure 2:
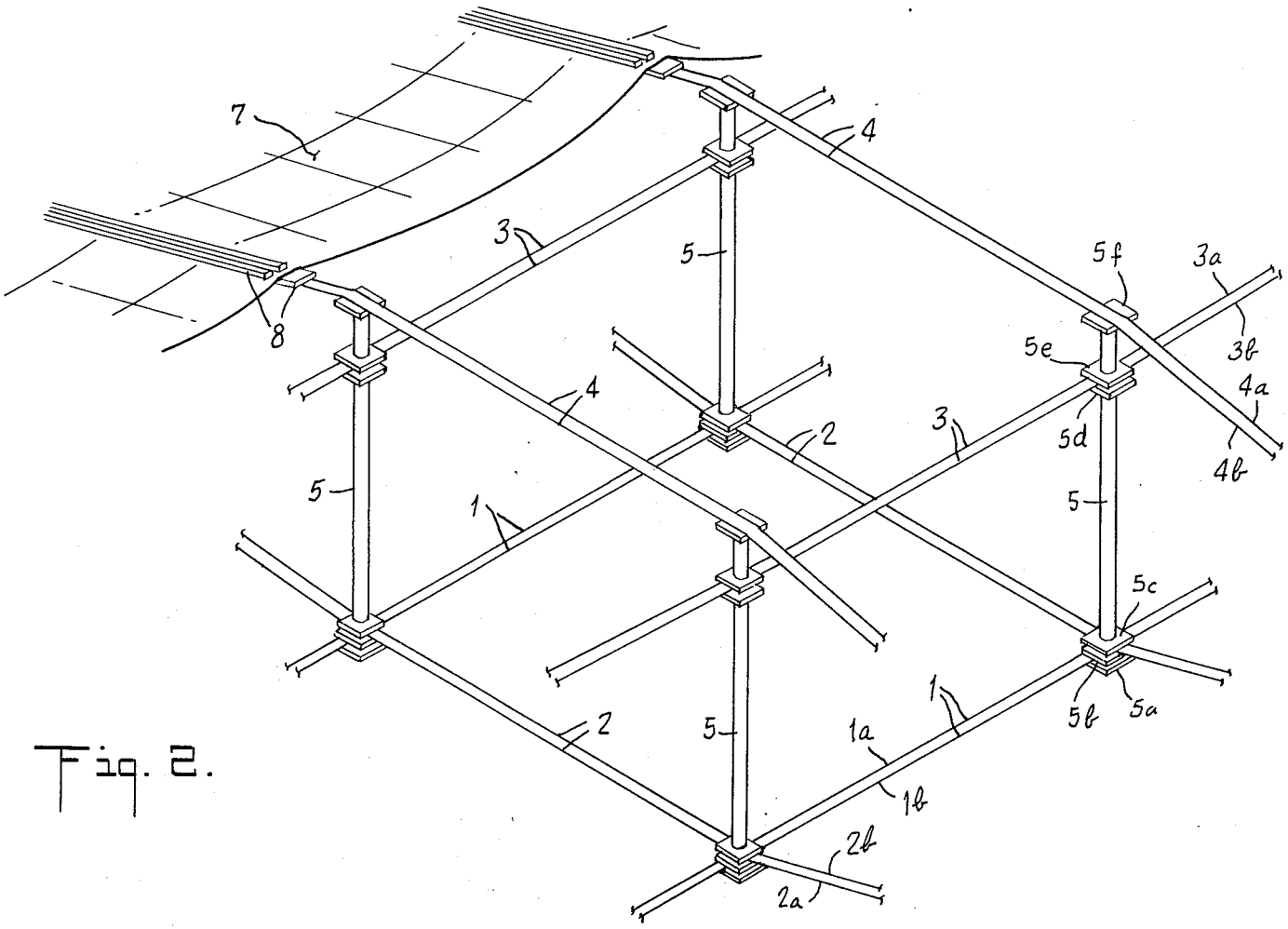
FIG. 2 is a partial perspective view showing upper and lower cable nets and compression struts and roof skin.
Figure 3:
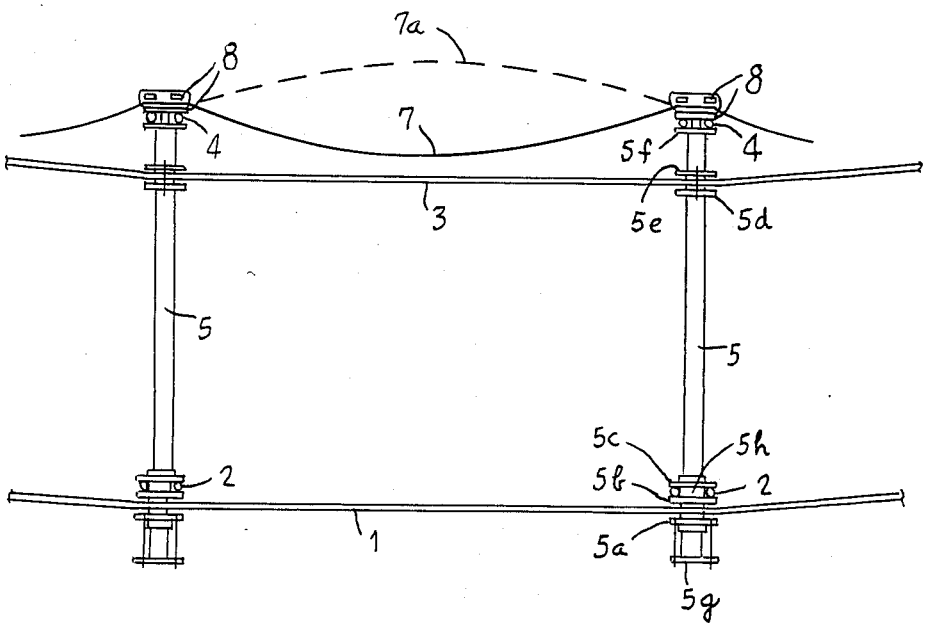
FIG. 3 is a detail of FIG. 2, showing an example of a connection between cables, compression struts and roof membrane.

Referring to FIGS. 2 and 3, lower restraining cables 2 and upper carrying cables 4 are substantially parallel to each other and to the long axis of edge ring 6 (in plan view), while lower carrying cables 1 and upper restraining cables 3 are substantially parallel to each other and to the short axis of ring 6 (also in plan view). Each compression strut 5 extends upwardly from a node of the lower net (a place where a lower carrying cable 1 intersects a lower restraining cable 2). Upper carrying cables 4 are secured to the top parts of compression struts 5 and, in the particular example discussed here, in which a fabric cover is used, upper restraining cables 3 are secured to intermediate parts of the respective compression struts. A membrane, such as a fabric cover 7, is secured to upper carrying cables 4 and forms troughs between the carrying cables of the upper net. Under downward loads, these troughs are anti-clastic (the trough has a convex curvature in elevational view along the long axis of ring 6 but a concave curvature in an elevational view along the short axis). Each lower carrying cable 1 in this non-limiting example is in fact made up of two subcables 1*a* and 1*b*, which are parallel to and spaced from each other in plan view, and similarly each lower restraining cable 2 is in fact made up of two subcables 2*a* and 2*b*, also parallel to and spaced from each other in plan view. In addition to other benefits, this allows for a convenient connection between compression strut 5 and the node. The compression strut can, for example, consist of a steel tube sliding through a steel sleeve 5*h* at the lower end. The steel sleeve has a horizontal plate 5*a* welded to its bottom part and rests on the node. A part of the sleeve can extend downwardly through the space between adjacent subcables 1*a* and 1*b*, to space them from each other, and the subcables can be secured between a plate 5*b* above them and plate 5*a* below. The plates can be bolted, for example with bolts (not shown) which keep the subcables from separating. The same bolts can similarly secure cables 2*a* and 2*b* at the same node, by means of a similar plate 5*c*. The steel tube can extend downwardly through the sleeve 5*h* and has a plate 5*g* welded to its bottom end. This plate can be attached to plate 5*a* by threaded rods which allow upward push on the tube as one means of stressing the cable nets. Similarly, upper restraining cable 3 in fact can be comprised of two subcables 3*a* and 3*b*, similarly secured to strut 5 by means of two similar plates 5*d* and 5*e* bolted to each other (at least one of them can be affixed to strut 5, and subcables 3*a* and 3*b* can flank the strut). Each upper carrying cable 4 can be a single cable, as illustrated, or can be a pair of spaced (in plan view) subcables 4*a* and 4*b*. In each case cables 4 can be secured to the top of the respective struts 5, as by a similar arrangement of two plates 5*f* and 5*g* bolted together, at least one of them affixed to strut 5. Long runs of roof fabric 7 are secured between adjacent runs of cables 4, as by means of upper and lower strips 8 which are bolted or otherwise fastened to each other and to plates 5*g* such that each superimposed pair of strips 8 secures the edes of two adjacent runs of roof fabric 7 to each other and to the respective strut plates 5*g*.

Figure 4:
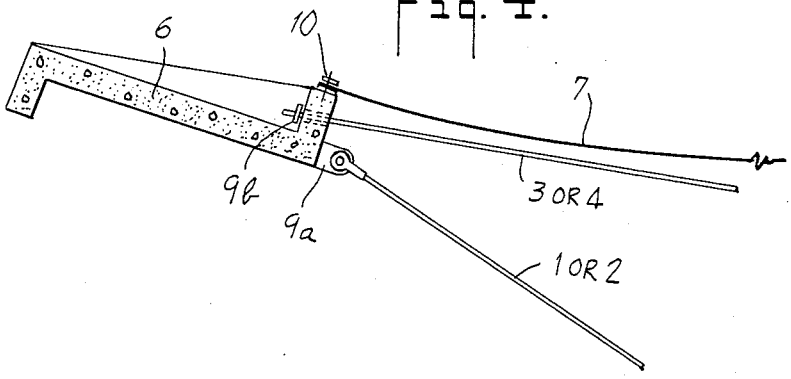
FIG. 4 is a detail showing an example of a connection between cables, roof membrane and edge ring.

To erect a structure embodying a non-limiting example of the invention, a support is first constructed for edge ring 6. For example, the support can comprise a conventionally constructed wall, which can be rectangular in elevational view and is superelliptic in plan view, and can match the shape of edge ring 6 in plan view. Columns or posts 11 of suitable varying heights can be added to match the curvature of edge ring 6 in elevational view. Edge ring 6 is then constructed, for example by casting it in reinforced concrete in situ, or by assembling it from precast concrete subassemblies, or by constructing it of welded or otherwise fastened steel beams. After constructing edge ring 6, lower carrying cables 1 are secured thereto, for example by securing one end of a cable 1 to a suitable fastener on one side of edge ring 6, then moving the other end of the cable to the opposite end of ring 6, as by a crane or helicopter, and securing it thereto by a similar fastener. The fasteners can be plates 9*a* or anchors 9*b* illustrated in FIG. 4, affixed to edge ring 6. Then, another lower carrying cable 1 is similarly secured to edge ring 6, and the process is repeated until all lower carrying cables 1 have been mounted. A lower restraining cable 2 is then similarly secured to one end of edge ring 6 and is run over lower carrying cables 1 and similarly secured to the opposite end of edge ring 6, and the process is repeated for the remaining lower restraining cables 2. Again, after securing one end of a lower restraining cable 2 to the edge ring 6, the cable can be moved over to the opposite end of ring 6 by helicopter, or by a crane with a sufficient reach, or by a smaller crane which is able to lay a lower restraining cable 2 over only one or a few carrying cables 1 at a time, and can step along the intended run of a lower restraining cable. The upper restraining cables 3 are next similarly installed and secured to edge ring 6, and then compression struts 5 are installed, for example one by one, and each is secured at its bottom to a respective node of the lower cable net and to the vertically aligned part of the respective upper restraining cable 3. Next, the upper carrying cables 4 are similarly installed, for example one by one, by securing one end of each to edge ring 6, running the free end over the lower cable net and the upper restraining cables, and over the tops of the vertically aligned compression struts, and securing it to the opposite side of edge ring 6 and the struts. When this is completed for all upper carrying cables 4, the structure is ready for prestressing. The cables are prestressed in a selected sequence, using techniques similar to those used for prestressing cable domes of the types discussed in the prior art referred to in the background section of this specification. Prestressing is achieved by extension of the struts 5, by tensioning of cables using anchors 9*b*, or by a combination of these methods. The prestressing is carried out to load edge ring 6 primarily in compression and to distribute the loads substantially uniformly throughout the cable nets, as well as to achieve the desired cable curvatures. Fabric or other roof material strips are then secured to the upper carrying cables, for example as illustrated in FIGS. 2 and 3. The edges of roof fabric runs 7 abutting edge ring 6 are secured thereto by upper and lower strips 10 illustrated in FIG. 4. The lower strip 10 is affixed to edge ring 6 and is coextensive therewith, and the upper strip 10 is superimposed thereon and fastened thereto. The roof fabric edge is between the two strips 10.

Figure 5:
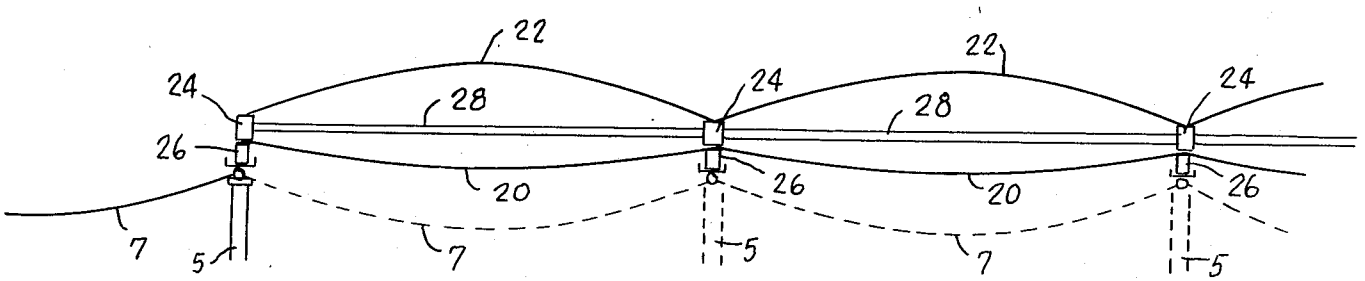
FIG. 5 illustrates details for retracting a center portion of the roof.

The structure can be provided, if desired, with retractable roof panels. One method of achieving a retractable roof uses inflated membrane fabric pillows as illustrated in FIG. 5. The pillows comprise a lower fabric run 20, an upper fabric run 22, a frame member 24 running on top of tracks 26, and spacer struts 28 keeping the distance between adjacent frame members 24 and balancing the fabric stresses induced to frame members 24.

Figure 6:
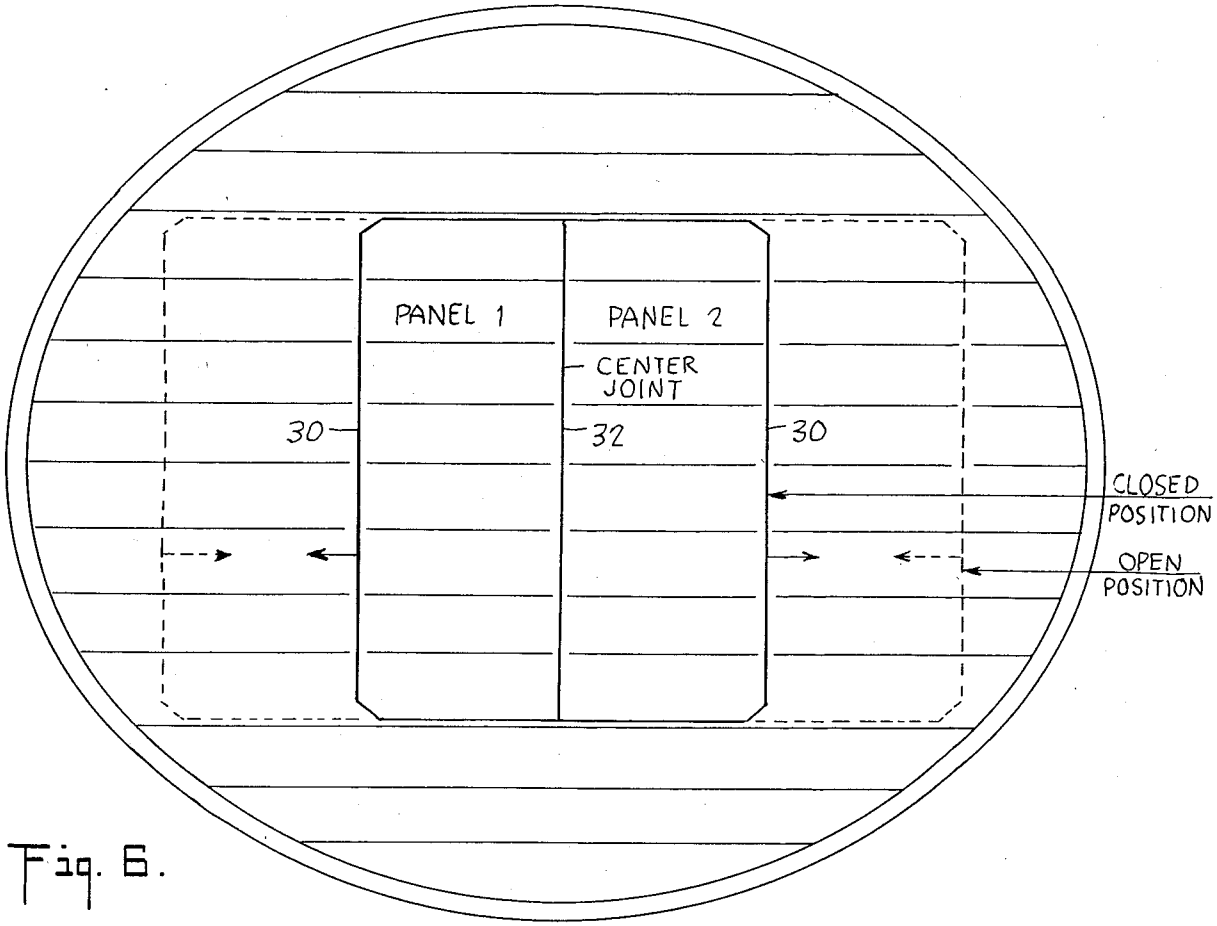
FIG. 6 shows a retractable roof opening in plan view.

The operable opening can be approximately as shown in FIG. 6. In addition to the components enumerated above, it shows the location of end frame members 30 and center joint 32. The center joint will be shaped so that one frame has an extension overlapping the other frame preventing rain water from entering the space.

Each pillow can be sealed and inflated to keep its shape by internal pressure which can be set to be safely above the design downward load. This pressure can be kept constant or can be adjusted by means of sensors for particular load conditions such as heavy snow fall. All pillow cells can be open to each other so that the air pressure is constant throughout the system.

In each pillow, upper fabric 22 has a larger curvature than lower fabric 20. This is done for two reasons:

(1) under wind suction, the upper membrane experiences stresses from both the internal pressure and the wind suction. The large curvature allows these loads to be carried at moderate stress levels (on the other hand the lower fabric is only loaded by the controlled interior pressure), and (2) in case of accidental failure of the pressure system or puncture of either membrane, the outer membrane will deflate and rest on the lower membrane. Because of the considerably larger curvature, only a small area will drape over the spacer struts which are designed to carry such loads in bending.

The spacer struts and the interior and exterior frame members are hinged at every panel point so that the movable roof portion can adjust to the curvature of the roof both in the closed condition due to the impact of superimposed loads as well as during the opening and closing of the roof. The panels can be moved between their shown positions, on which parts of the roof are open, as shown in FIG. 6, and closed positions, in which they move as shown by arrows in FIG. 6, to close the roof, by suitable motorized cables (not shown).

In situations where the frames and spacer struts can be protected against corrosion and where there are no excessive snow loads, the outer membrane can be eliminated. In this case, the lower membrane acts as a pure tension membrane similar to the system described for the main roof.

I claim:

1. A cable dome system comprising:

a substantially rigid, generally laterally extending edge ring loaded primarily in compression;

a lower cable net secured to the edge ring and comprising a set of lower carrying cables intersected at respective lower nodes by lower restraining cables to form in plan view a substantially rectangular lower grid;

an upper cable net secured to the edge ring and comprising a set of upper carrying cables aligned in plan view with the lower restraining cables and intersected in plan view at respective upper nodes by upper restraining cables aligned in plan view with the lower carrying cables to form, in plan view, a substantially rectangular upper grid;

a set of compression struts each securing a respective lower node to the upper node aligned therewith in plan view;

wherein each carrying cable has a sufficiently greater curvature in elevational view than the restraining cable aligned therewith in plan view to serve as the primary carrier of vertical loads as compared with the restraining cable, the upper carrying cables have convex curvatures and the lower carrying cables have concave curvatures in elevational view, and the upper carrying cables are above and spaced from the upper restraining cables; and a membrane secured to and forming troughs between the upper carrying cables.

2. A cable system as in claim 1 including a supporting structure maintaining at least a part of the edge ring above ground level.

3. A cable system as in claim 2 in which each of the cables of the lower net and of the restraining cables of the upper net 1 are comprised of two sub-cables which are substantially parallel to, and are laterally spaced from, each other.

4. A cable system as in claim 3 in which each strut passes between the sub-cables of each of the upper restraining cables.

5. A cable system as in claim 1 in which the membrane covers only a portion of the area defined by the edge ring, to leave at least one roof opening, and including at least one roof panel selectively movable between a closed position, in which it covers the at least one roof opening, and an open position in which it does not.

6. A method of erecting a dome system comprising;

providing a substantially rigid and generally laterally extending edge ring;

suspending from the ring a set of lower carrying cables which are spaced from and generally parallel to each other;

suspending from the ring a set of lower restraining cables which are spaced from and generally parallel to each other and are transverse to and over the carrying cables;

suspending from the ring a set of upper restraining cables which are aligned in plan view with the lower carrying cables;

securing to each node at which a lower carrying cable intersects a lower restraining cables, an upwardly extending, elongated compression strut, and securing the upper restraining cables to intermediate portions of said struts;

suspending from the ring a set of upper carrying cables which are aligned in plan view with the lower restraining cables and are above the upper restraining cables, and securing the upper carrying cables to top portions of said struts;

wherein the carrying cables have a sufficiently greater curvature in elevational view than the restraining cables aligned therewith in plan view to serve as the primary carriers of vertical loads;

prestressing the cables to place the edge ring primarily in compression; and securing roof skin to the upper carrying cables.

7. A method as in claim 6 in which the step of securing roof skin to the upper cables comprises securing fabric skin thereto.

8. A method as in claim 7 in which the step of securing the upper carrying cables to the struts comprises securing said upper carrying cables to strut positions sufficiently higher than those at which the upper restraining cables are secured to the struts to allow the roof fabric to form troughs which are flanked by upper carrying cables and have bottoms which are above the upper restraining cables.

9. A method as in claim 6 including leaving at least one opening in the roof membrane and providing a movable roof panel which selectively covers said roof membrane opening.

* * * * *